United States Patent [19]

Theurer

[11] Patent Number: 5,031,542

[45] Date of Patent: Jul. 16, 1991

[54] MOBILE TRACK TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 472,204

[22] Filed: Jan. 30, 1990

[30] Foreign Application Priority Data

Apr. 18, 1989 [AT] Austria ..... 920/89
Apr. 18, 1989 [AT] Austria ..... 921/89

[51] Int. Cl.[5] ..... E01B 27/12; E01B 27/20
[52] U.S. Cl. ..... 104/12
[58] Field of Search ..... 104/10, 12

[56] References Cited

U.S. PATENT DOCUMENTS

| | | | |
|---|---|---|---|
| 3,011,452 | 12/1961 | Plasser et al. | 104/12 |
| 3,426,697 | 1/1967 | Stewart | 104/12 |
| 3,534,687 | 10/1970 | Plasser et al. | 104/12 |
| 3,669,025 | 6/1972 | Plasser et al. | 104/12 |
| 4,094,250 | 6/1978 | Theurer | 104/12 |
| 4,428,297 | 1/1984 | Ganz | 104/12 |
| 4,445,437 | 5/1984 | Nielsen | 104/12 |
| 4,534,295 | 8/1985 | Theurer | 104/12 X |
| 4,537,135 | 8/1985 | Theurer | 104/12 |
| 4,572,079 | 2/1986 | Theurer | 104/12 X |
| 4,576,095 | 3/1986 | Theurer | 104/12 |
| 4,625,651 | 12/1986 | Theurer | 104/12 X |

FOREIGN PATENT DOCUMENTS 2201178 2/1988 United Kingdom .

*Primary Examiner*—Robert J. Oberleitner
*Assistant Examiner*—S. Joseph Morano
*Attorney, Agent, or Firm*—Kurt Kelman

[57] ABSTRACT

A mobile track tamping machine comprises a machine frame, undercarriages mounting the machine frame on a track, and a plurality of independently transversely and vertically adjustable tamping tool units aligned transversely to the track, each tamping tool unit comprising a pair of reciprocable vibratory tamping tools including tamping picks immersible in the ballast, drives for reciprocating the tamping tools in a direction extending substantially perpendicularly to the ties and for vibrating the tamping tools, and a drive for vertically adjusting the tamping tool unit. Respective transversely pivotal carrier frames for two of these tamping tool units are mounted on the machine frame, each carrier frame being pivotal about a vertical axis in a plane extending substantially parallel to the track, and an independent drive is connected to each carrier frame for pivoting the carrier frame.

26 Claims, 4 Drawing Sheets

Fig. 6
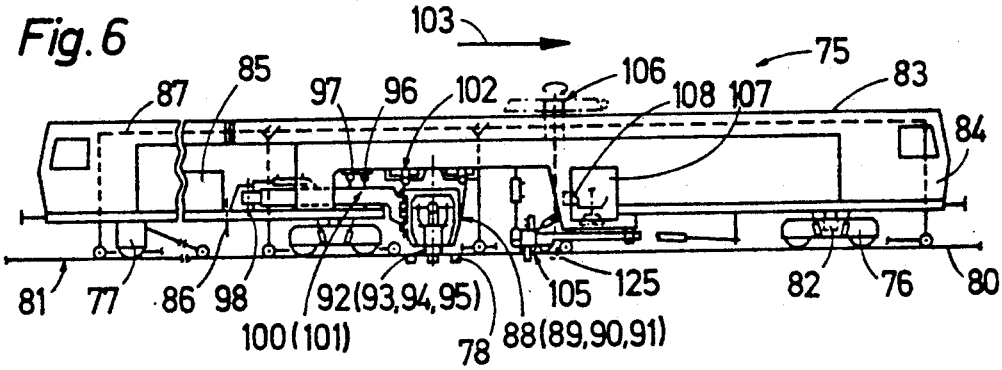
Fig. 7
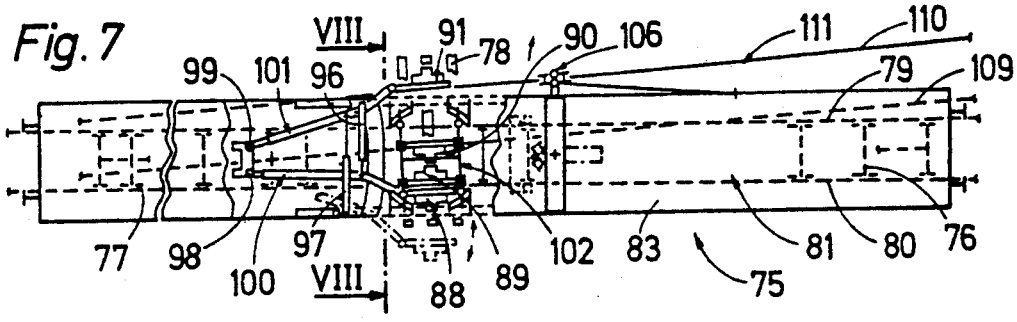
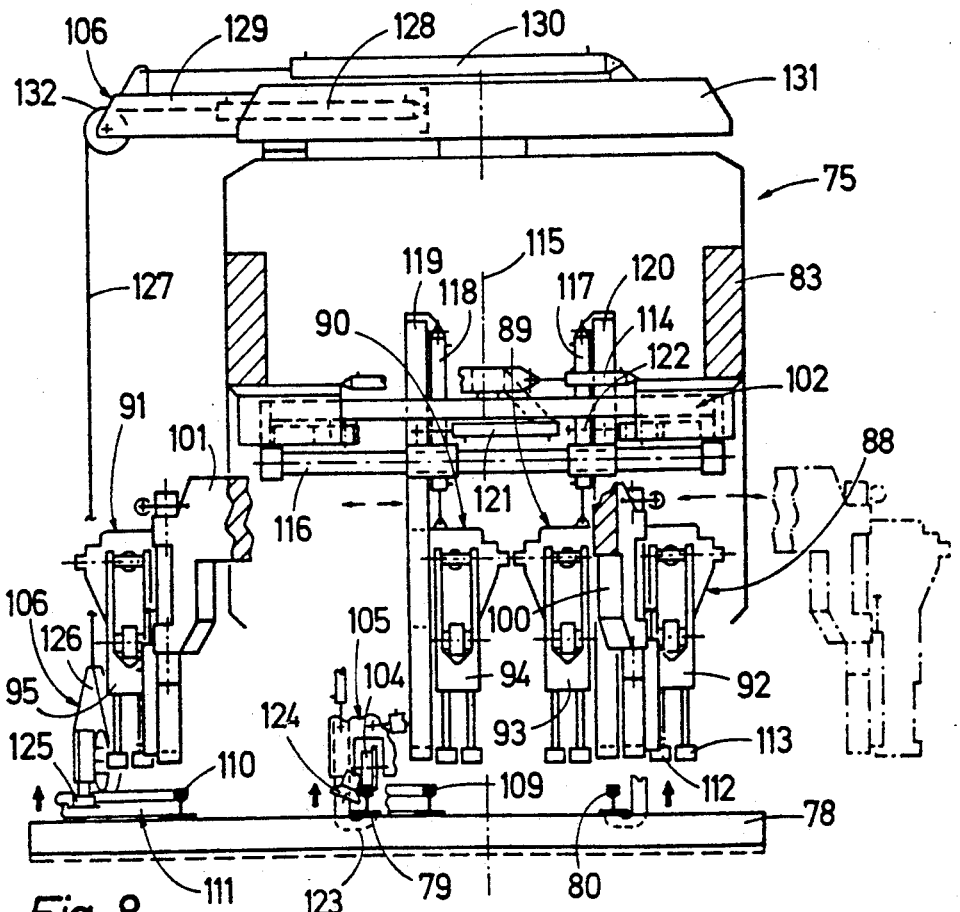
Fig. 8

MOBILE TRACK TAMPING MACHINE

BACKGROUND OF THE INVENTION (1) Field of the Invention

The present invention relates to a mobile track tamping machine comprising a machine frame, undercarriages mounting the machine frame on a track for mobility in an operating direction, the track being comprised of two rails fastened to ties supported on ballast, each rail having a gage side and a field side, and a plurality of independently transversely and vertically adjustable tamping tool units aligned transversely to the track, each tamping tool unit comprising a pair of reciprocable vibratory tamping tools including tamping picks immersible in the ballast, drive means for reciprocating the tamping tools in a direction extending substantially perpendicularly to the ties and for vibrating the tamping tools, and a drive for vertically adjusting the tamping tool unit.

(2) Description of the Prior Art

A mobile track tamping machine of this general type is known, for example, from U.S. Pat. No. 3,534,687, dated Oct. 20, 1970. This machine comprises two cantilevered carrier frames for two tamping tool units, each comprising two sequentially arranged pairs of reciprocatory and vibratory tamping tools for simultaneously tamping two adjacent ties. The carrier frames are mounted on a machine frame portion which is laterally pivotal about a vertical axis and are independently transversely displaceable on the machine frame portion by independent transverse adjustment drives. The tamping tool picks are independently laterally pivotal and this machine, with its cantilevered tamping tools, may be used for tamping ties in switches and as a track leveling, lining and tamping machine when combined with a leveling and lining reference system.

U.S. Pat. No. 3,426,697, dated Feb. 11, 1969, also relates to a switch tamper with a cantilevered tamping tool arrangement, i.e. a type of tamper hardly used any more for about twenty years. Respective tamping tool units associated with each track rail are mounted on an elongated carrier frame which is pivotal about a vertical axis on the machine frame and the vertically adjustable tamping tool units are independently transversely displaceable on the carrier frame, the arrangement being designed to enable the tamping tools to be repositioned in encountered in switches. This structure is expensive because the pivotal carrier frame extends over the entire machine frame to the rear end thereof where it is glidingly affixed by a sliding bearing to enable the elongated carrier frame to be pivoted. Furthermore, the arrangement has the disadvantage that the tamping tools are pivoted on a common carrier frame and, therefore, cannot be properly centered with respect to the tie to be tamped since the pivoting axis of the carrier frame is spaced from the center of the transverse displacement guide. In other words, the tamping picks will not extend parallel to the tie being tamped and, therefore, the quality of tamping will be poor.

U.S. Pat. No. 4,625,651, dated Dec. 2, 1986, discloses a modern track switch leveling, lining and tamping machine of the compact type, the tamping tool units and the track lifting and lining unit being arranged between two widely spaced undercarriages, which not only enables the accuracy of leveling and lining to be enhanced considerably but also makes it possible to reduce the extent of rail bending during the track correction to a minimum because of the wide spacing of the undercarriages holding down the respective ends of the track section being corrected and thereby to protect the rails from undue stresses. A carrier frame is associated with each track rail and supports a tamping tool unit and a longitudinally adjustable coupling pivotally links one end of each carrier frame to the machine frame while a free steering gear supports an opposite end of each carrier frame on the associated track rail. A track switch lifting and lining unit is also mounted on each carrier frame.

U.S. Pat. No. 4,576,095, dated Mar. 18, 1986, discloses a ballast tamping machine with two independently transversely adjustable tamping tool units, each unit comprising a pair of reciprocatory and vibratory tamping tools respectively arranged at the field side and the gage side of each track rail. Each pair of tamping tools is independently vertically adjustable so that the machine may be used even in difficult switch areas by raising any pair of tamping tools out of its operative position when it encounters an obstacle.

British patent application No. 2,201,178, published Aug. 24, 1988, deals with a switch tamper of the cantilevered type wherein four tamping tool units are independently vertically and transversely adjustable. This machine has no track lifting and lining unit. Independently adjustable tamping tool units are also known from U.S. Pat. Nos. 3,669,025, dated June 13, 1972, and No. 4,445,437, dated May 1, 1984, wherein two pairs of tamping tools are associated with each track rail, the four pairs of tamping tools form independently vertically adjustable tamping tool units and are independently transversely displaceable on a carrier frame mounted on the machine frame. While these arrangements adapt the machine for work in most switch areas, they do not work satisfactorily in areas of non-uniform crib widths and where obliquely positioned ties are to be tamped.

SUMMARY OF THE INVENTION

It is the primary object of this invention to provide a mobile track tamping machine which may be effectively used even in the most difficult track sections, such as switches or tracks with obliquely positioned and/or differently spaced ties, and in which the tamping tools may be rapidly, simply and accurately positioned in accordance with the position of the tie to be tamped.

The above and other objects are accomplished according to the invention in a mobile track tamping machine of the first-described type by mounting respective transversely pivotal carrier frames for two of the transversely aligned tamping tool units on the machine frame, each carrier frame being pivotal about a vertical axis in a plane extending substantially parallel to the track, and connecting an independent drive to each carrier frame for pivoting the carrier frame.

This pivotal support for two of the tamping tool units provides an unexpectedly simple yet robust carrier structure for the tamping tools, which is strong enough to resist the relatively powerful forces to which it is subjected in difficult and heavy track sections and which, furthermore, can be embodied in a variety of structural embodiments in accordance with different tamping tool units for switches and tangent track. The structurally simple pivotal carrier frames for the tamping tool units will fully absorb the high impact forces encountered during tamping while the individual transverse adjustability of the tamping tool units by independent drives will enable all the tamping tools to be properly centered with respect to the tie to be tamped and to the associated rail where a branch track branches off the main track in a switch, for example. On the other hand, a machine equipped with such pivotal carrier frames for the tamping tool units may be readily used in tangent track, too, so that it may be used without interruptions along long stretches of track, including switches, thus providing an economical track tamper producing the highest quality of tamping in all track sections. In this respect, it is of particular advantage that the pivotal repositioning of the tamping tool units also enables the tamping picks to be adapted to the obliquely positioned long ties encountered in track switches.

BRIEF DESCRIPTION OF THE DRAWING

The above objects, advantages and features of the invention will become more apparent from the following detailed description of certain now preferred embodiments thereof, taken in conjunction with the accompanying, partly schematic drawing wherein

FIG. 6 is a side elevational view of another embodiment of a mobile track leveling, lining and tamping machine with respective transversely pivotal carrier frames for two field-side tamping tool units associated with the respective track rails while the two gage-side tamping tool units are mounted on a tamping tool carrier and are independently transversely adjustable;

FIG. 7 is a top view of the machine of FIG. 6, one of the pivotal carrier frames supporting one of the field-side tamping tool units being shown in an outwardly pivoted position for tamping at a branch track;

FIG. 8 is an enlarged cross sectional view of the track tamper, taken along lines VIII—VIII of FIGS. 7 and 10;

DESCRIPTION OF THE PREFERRED EMBODIMENTS

Figure 1:
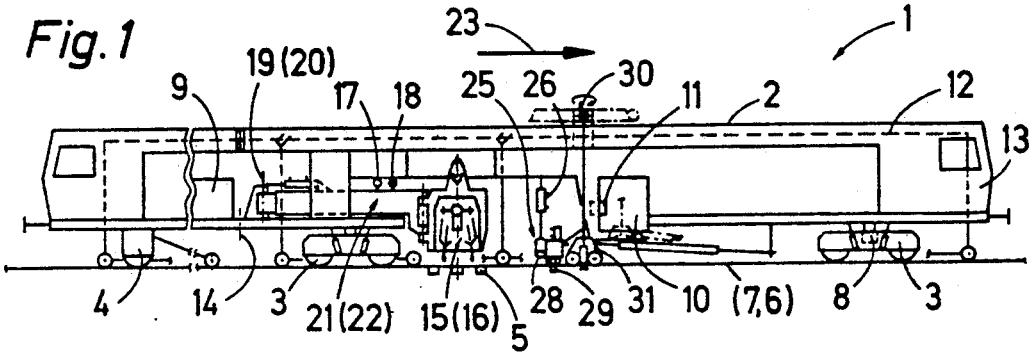
FIG. 1 is a side elevational view of one embodiment of a mobile track leveling, lining and tamping machine with respective transversely pivotal carrier frames for two tamping heads, each having two tamping tool units.
Figure 2:
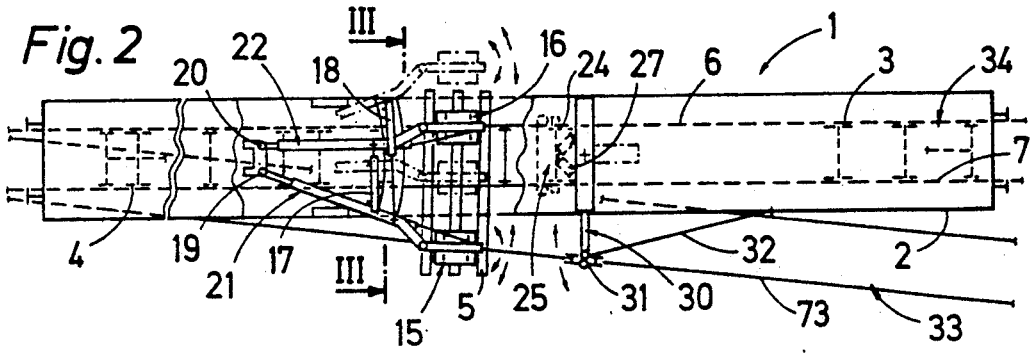
FIG. 2 is a top view of the machine of FIG. 1, one of the pivotal carrier frames supporting one of the tamping heads being shown in an outwardly pivoted position for tamping at a branch track.
Figure 4:
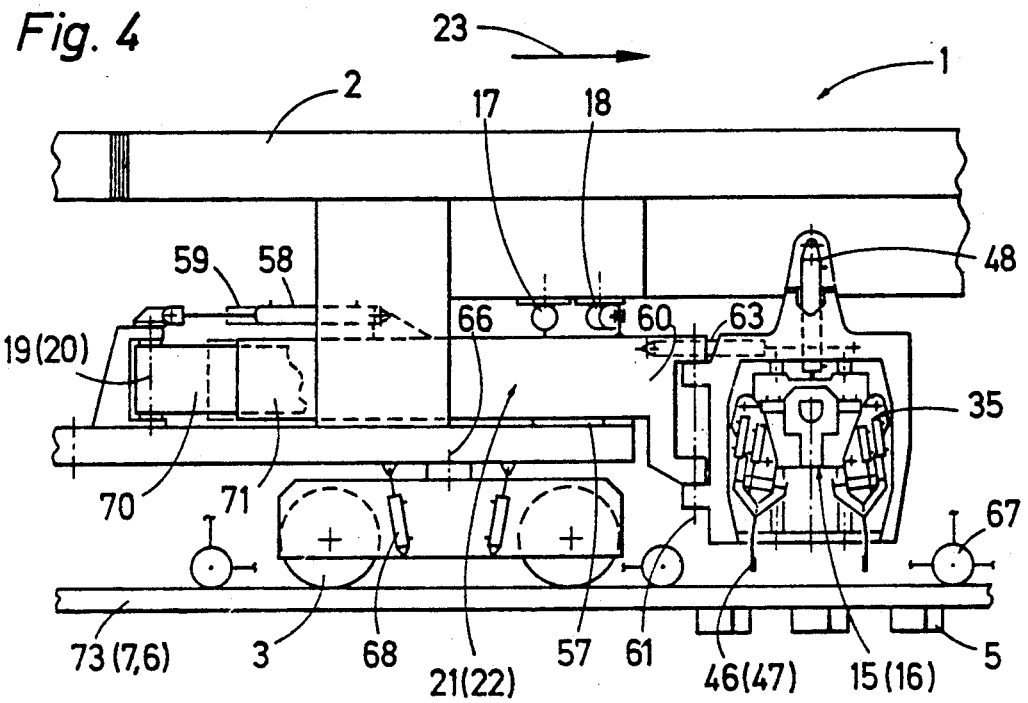
FIG. 4 is an enlarged fragmentary side elevational view showing the tamping head mounted on the pivotal carrier frame.

Referring now to the drawing and first to FIGS. 1 and 2, there is shown mobile track leveling, lining and tamping machine 1 comprising machine frame 2. Undercarriages 3, 4 mount machine frame 2 on track 34 for mobility in an operating direction indicated by arrow 23. Track 34 is comprised of two rails 6, 7 fastened to ties 5 supported on ballast, each rail having a gage side and a field side. Central power plant 9 provides energy for machine drive 8 and all the operating drives on the machine. Central control panel 11 is mounted in operator's cab 10 to control the operation of the machine. Track correction is controlled by leveling and lining reference system 12 comprising tensioned reference wires supported on rail sensing rollers 67 (see FIG. 4) running on the track rails. A respective driver's cab 13 is mounted on each end of machine frame 2. The illustrated elongated machine frame is an articulated frame comprising two parts linked together for pivoting about vertical axis 14, undercarriages 3, 3 being swivel trucks supporting the front ends of the two machine frame parts and single-axle undercarriage 4 supporting the rear end of the rear machine frame part. As shown in FIG. 4, the frame of swivel truck 3 is linked to machine frame 2 by hydraulic drives 68 to enable the machine frame to be fixedly held on the swivel truck during operation of the machine, under exclusion of the spring force exerted by the shock absorbers.

Figure 3:
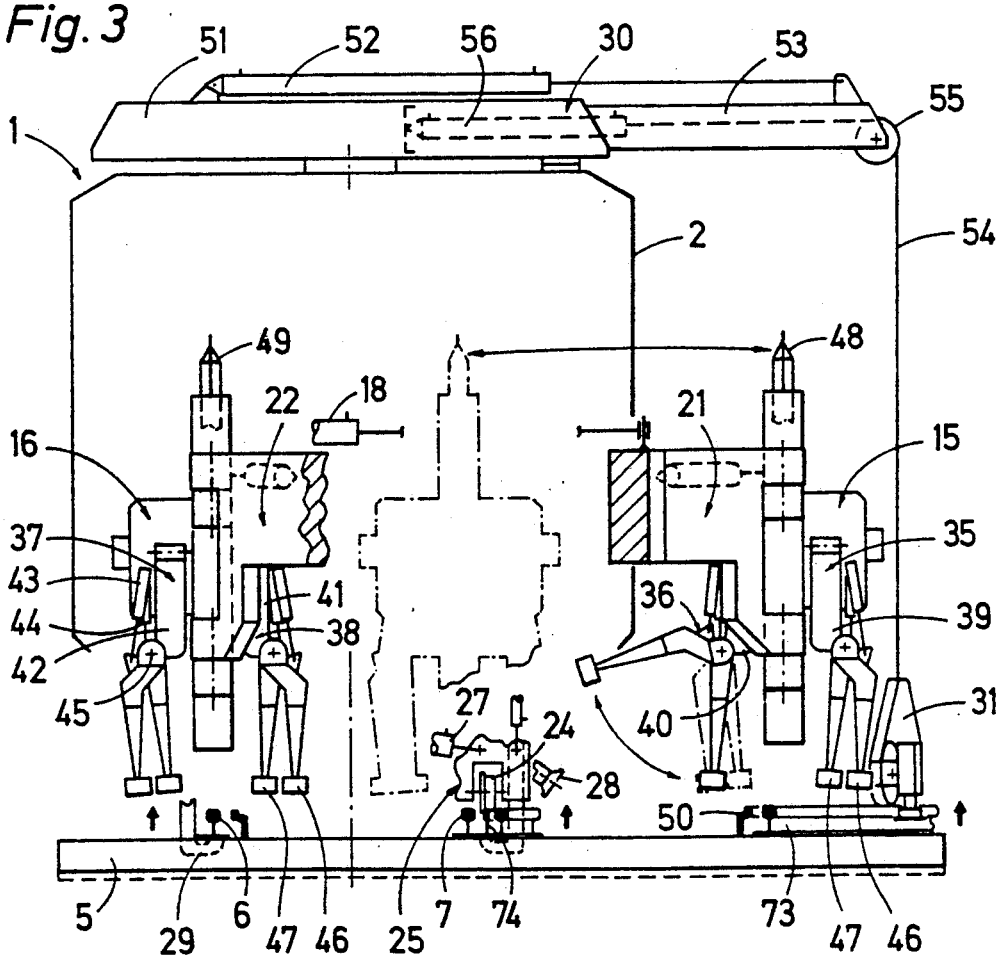
FIG. 3 is an enlarged cross sectional view of the track tamper, taken along lines III—III of FIGS. 2 and 5.

In this embodiment and as best shown in FIG. 3, two independently transversely and vertically adjustable tamping tool units 15, 16 are aligned transversely to the track, each unit comprising a respective pair 35, 36 and 37, 38 of reciprocable vibratory tamping tools 39, 40 and 41, 42 including tamping picks 46, 47 immersible in the ballast at the field side and the gage side of each rail 6, 7. Each tamping tool unit further comprises drive means for reciprocating the tamping tools in a direction extending substantially perpendicularly to the ties and for vibrating the tamping tools, and drive 48, 49 for vertically adjusting each tamping tool unit 15, 16 with respect to respective transversely pivotal carrier frames 21, 22 supporting the tamping tool units 15, 16 and mounted on machine frame 2, each carrier frame being pivotal about a vertical axis 19, 20 in a plane extending substantially parallel to the track, and an independent drive 17, 18 is connected to each carrier frame 21, 22 for pivoting the carrier frame. Each tamping tool is mounted for pivoting with its tamping pick 46, 47 in a transverse plane about axis 45 extending parallel to the track, and a drive 43, 44 is connected to each tamping tool for independently pivoting each tool. This known independent pivotal arrangement of the tamping tools enhances the adjustability of the tamping tools to even the most difficult track configurations and enables any tamping tool that would encounter an obstacle upon immersion in the ballast to be pivoted into an inoperative position.

Tamping tool units 15, 16 precede rear swivel truck 3 in the operating direction and are closely adjacent thereto, and vertical axes 19, 20 about which carrier frames 21, 22 are transversely pivotal trail this swivel truck in the operating direction. This rear swivel truck is arranged intermediate front swivel truck 3 and single-axle undercarriage 4 mounting respective ends of the machine frame parts. This illustrated arrangement provides a secure support for the carrier frames of the tamping tool units above the intermediate swivel truck so that they will withstand even the most powerful forces encountered during tamping and track leveling or lining but also enable the pivotal carrier frames to be accommodated on the machine frame without trouble. Driver's cabs 13 at the respective ends of machine frame 2 are preferably mounted above the front and rear undercarriages.

In the illustrated embodiment, swivel trucks 3, 3 are widely spaced and machine 1 further comprises track lifting and lining unit 25 capable of leveling and lining track switches mounted on machine frame 2 between the swivel trucks and preceding tamping tool units 15, 16 in the operating direction to form a track leveling, lining and tamping machine. Track lifting and lining unit 25 has a frame mounted on flanged rollers 24 on track rails 6, 7 and linked to machine frame 2 by lifting and lining drives 26, 27. Laterally pivotal lifting rollers 28 for engagement with the rail heads and vertically as well as laterally adjustable lifting hooks 29 for selective engagement with the rail heads or feet are mounted on the track lifting and lining unit frame to enable the unit to operate in track switches.

The illustrated switch leveling, lining and tamping machine further comprises transversely pivotal auxiliary track lifting device 30 mounted on machine frame 2 between swivel trucks 3, 3 and preceding track lifting and lining unit 25 in the operating direction for selectively lifting branch track 33 to the right or the left of track 34. As seen in FIG. 2, auxiliary track lifting device 30 comprises carrier frame 31 equipped with a pair of flanged rail engaging and lifting rollers, and the carrier frame is linked to machine frame 2 by bracing rod 32. As FIG. 2 illustrates, auxiliary track lifting device 30 as well as tamping tool unit 15 is transversely pivotal into alignment with branch track 33 while undercarriages 3, 4 of machine 1 run on main track The combination of the pivotal carrier frames for the two tamping tool units with a compact track leveling, lining and tamping machine with a long wheel base provides a switch tamper producing high-quality tamping and accurate track correction while at the same time assuring minimum flexing of the track rails during track leveling and/or lining so that the rails are not subjected to high stresses. The auxiliary track lifting device enables the branch track to be equally well leveled and tamped so that the entire switch area may be worked economically in a single operating stage with highest accuracy.

As shown in FIG. 3, auxiliary track lifting device 30 comprises telescopingly extensible two-part carrier arm 51, 53, the carrier arm part 51 being rotatably supported on machine frame 2 and a drive being connected to this carrier arm part to rotate the same about a vertical pivot. Drive 52 connects carrier arm parts 51 and 53 to enable the carrier arm to be longitudinally extended and retracted. The free outer end of carrier arm part 53 carries freely rotatable pulley 55 guiding rope 54 one end of which is affixed to hydraulic cylinder 56 housed inside carrier arm part 53 and the opposite end of which is attached to carrier frame 31 equipped with a pair of flanged rail engaging and lifting rollers.

As shown in FIG. 4, each carrier frame 21, 22 is elongated and has one end 60 supporting respective tamping tool unit 15, 16 and an opposite end pivoted about vertical axis 19, 20. Machine frame 2 comprises horizontally extending sliding and guide bearing element 57 supporting each carrier frame adjacent the one end. The one carrier frame end 60 projects freely in the operating direction from intermediate swivel truck 3 and a respective vertical axis 19, 20 about which elongated carrier frames 21, 22 is transversely pivotal is in substantially vertical alignment with a respective rail 6, 7. This arrangement of the tamping tool units at the free ends of the pivotal carrier frames has the advantage that the pivoting path of the tamping tool units is free of other structures and that the tamping tool units may be observed freely and in an unobstructed view by an operator in cab 10, i.e. at the side of the tamping tool units facing away from the side mounted on the carrier arms. The elongated dimension of the carrier arms projects the tamping tool units at their free outer ends into a position widely spaced from the carrier arm pivots so that their transverse adjustment path is long enough to enable the tamping tool units to be aligned with a branch track connected with the main track by long ties in a switch area. The sliding and guide bearing element supports each carrier arm on the machine frame securely in every pivoted position, the entire structure resting on the intermediate swivel truck for added support. Providing the pivoting axis for the carrier frames in vertical alignment with the track rails enables the tamping tool units to be centered with respect to obliquely positioned ties.

In the illustrated embodiment, each carrier frame 21, 22 is an elongated, telescopingly longitudinally extendable multi-part frame comprised of inner frame part 70 and outer frame part 71, and drive 58, 59 is connected to each carrier frame for longitudinally extending and retracting the multi-part frame whereby tamping tool unit 15, 16 on the carrier frame is longitudinally repositioned with respect to the track. As shown, inner frame part 70 is pivoted to machine frame 2 in a bearing bracket and drive 58, 59 connects outer frame part 71 to the bearing bracket. The illustrated multi-part carrier frames have a rectangular cross section and independent drive 18, 19 connected to each carrier frame for pivoting the carrier frame and drive 58, 59 for longitudinally extending and retracting each carrier frame are hydraulic drives connected to an upper portion of the rectangular carrier frames. Making the carrier frames for the tamping tool units longitudinally adjustable enables the independent repositioning of the tamping tool units to be effected readily to center the tamping tools accurately over the ties to be tamped, including obliquely positioned ties. Telescopingly extendable carrier frames of rectangular cross section, with hydraulic extension drives mounted on an upper portion of the rectangular frames, provide simple and robust carriers which may be extended and retracted independently in each pivoting position without interference.

Figure 5:
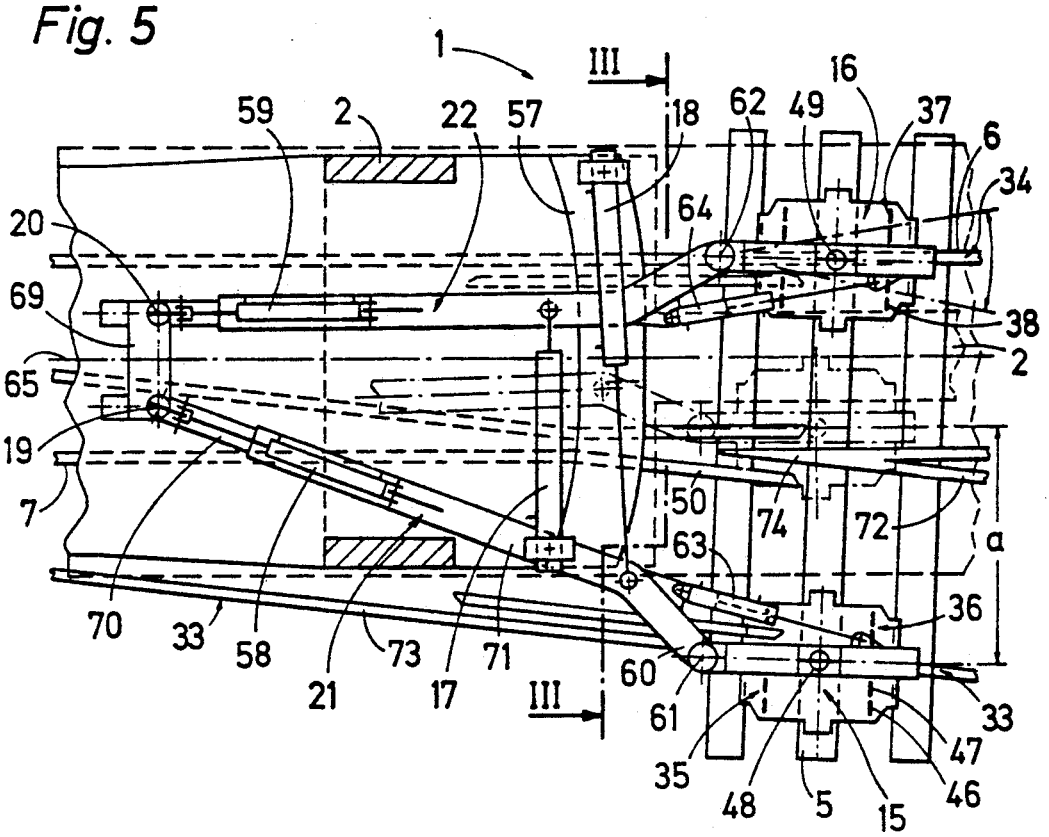
FIG. 5 is a enlarged fragmentary top view showing the two pivotal carrier frames and the tamping heads supported thereon, operating in a track switch.

As shown in FIG. 5, the inner ends of carrier frames 21, 22 are pivoted at 19, 20 on a common bearing bracket 69. The one end 60 of each elongated carrier frame is angled outwardly from center axis 65 of track 34 and the distance between vertical pivoting axis 19, 20 and tamping tool unit 15, 16 supported on the one carrier frame end 60 is at least about 4 to 5 meters whereby the pivoting path of the one end 60 of each carrier frame is in the range of about 1.7 m. The innermost pivoting position of the carrier frames between rails 6 and 7 of main track 34 is indicated in chain-dotted lines. Branch track 33 is comprised of rails 72 and 73, and frog 74 extends between the main and branch tracks. The illustrated carrier frame configuration further extends the pivoting path of the tamping tool units mounted on the outwardly angled carrier frame ends and enhances their ability to conform their position to obliquely positioned ties. This maximal adaptability of the tamping tool positions to existing track configurations and tie positions makes it possible to tamp even the most difficult switch areas in a single pass, including the tamping of the long ties connected the branch track to the main track in a switch.

As shown in FIGS. 4 and 5, angled end 60 of each carrier frame 21, 22 pivotally supports a respective tamping tool unit 15, 16 about another vertical axis 61, 62, and drive 63, 64 is connected to each tamping tool unit for transversely pivoting each tamping tool unit towards and away from center 65 of track 34. Vertical axis 19, 20 of each carrier frame is arranged rearwardly of center axis 66 of intermediate swivel truck 3. In this arrangement, the entire transverse pivoting path of each tamping tool unit is about 2 m. As shown, carrier frames 21, 22 with their vertical pivoting axes 19, 20, drives 17, 18, 63, 64 and pivoting paths are arranged mirror-symmetrically with respect to center axis 65 of machine 1. Such an arrangement combines in a particularly advantageous manner a simple and robust transversely pivotal mounting of the tamping tool units for their independent transverse positioning with a rapid and accurate centering of the tamping picks with respect to obliquely positioned ties independently of the transverse positioning by pivoting the tamping tool units on their pivotal carrier frames. This makes it possible for the first time to tamp effectively not only in the presence of a variety of track obstacles in difficult switches but also to adapt the position of the tamping picks to obliquely positioned long ties in such switches. In view of the wide pivoting range, tamping is possible even at the outer rail of the branch track. The mirror-symmetrical arrangement will enable the two tamping tool units to be operated without interfering with each other and also provides an even load distribution over machine frame 2.

Mobile track leveling, lining and tamping machine 1 illustrated in FIGS. 1 to 5 operates in the following manner:

When the machine is operated along tangent main track 34, the two carrier frames 21, 22 are pivoted by hydraulic drives 17, 18 until the pairs of tamping tools of tamping tool units 15, 16 straddle track rails 6 and 7 (see the position of tamping tool unit 15 shown in chain-dotted lines in FIG. 3). For leveling and lining of main track 34, track lifting and lining unit 25 is operated under the control of leveling and lining reference system 12 without use of auxiliary track lifting device 30. When the switch with main track 34 and branch track 33 is reached (see FIGS. 2, 3 and 5), tamping tool unit 15 is pivoted transversely by drive 18 until it straddles outer rail 73 of the branch track. In addition to this pivoting movement, carrier frame 21 supporting the tamping tool unit is somewhat longitudinally extended by drive 58 until pairs 35, 36 of the tamping tools with their tamping picks 46, 47 are centered exactly with respect to the point of intersection of long tie 5 and branch track rail 73. If necessitated by an obstacle, such as wheel guide rail 50, in the way of a particular tamping pick, this tamping pick is laterally pivoted into an inoperative position by hydraulic drive 43, 44. At the same time, hydraulic drive 63 may be operated to pivot tamping tool unit 15 slightly about vertical axis 61 until tamping picks 46, 47 come to extend exactly parallel to obliquely positioned tie 5 to be tamped. The other tamping tool unit 16 remains in its position to tamp the tie at main track rail 6.

For leveling, the two lifting hooks 29 and, if needed, the two lifting rollers 28 are brought into engagement with rails 6, 7 of main track 34. The track lifting rollers on carrier frame 31 of auxiliary track lifting device 30 are then engaged with outer rail 73 of branch track 33 and hydraulic lifting and lining drives 26, 27 of track lifting and lining unit 25 as well as hydraulic drive 56 of auxiliary track lifting device 30 are then operated under the control of leveling and lining reference system 12, the switch being engaged at three points during the leveling and lining operation, as indicated by three small, upwardly pointing arrows in FIG. 3. In this correct track position, the tie is tamped by tamping tool units 15, 16 to fix the switch in the desired position. Before the tamping tool units are lowered by operation of hydraulic drives 48, 49 to immerse tamping picks 46, 47 in the ballast for tamping the same under the tie, any tamping pick in vertical alignment with a track obstacle, such as guide rail 50, is pivoted upwardly into an inoperative position by operation of hydraulic drive 43, 44. After the tamping, tamping tool unit 15 is raised and carrier frame 21 is transversely pivoted by operation of hydraulic drive 18 until the tamping tool unit is positioned above frog 74, hydraulic drive 63 being also operated for pivoting the tamping tool unit on the carrier frame if this is required for proper centering of the tamping tools. After tamping picks 46, 47 have been pivoted by drives 43, 44 for adaptation to guide rails 50 at both sides of the frog, tamping tool unit 15 is lowered for tamping the ballast under the tie in this area. Upon completion of this tamping, the tamping tool unit is raised again and machine 1 is advanced to the next tie where the above-described tamping cycle is repeated.

In the very advantageous embodiment of FIGS. 1 to 6, the overall structure of mobile track leveling, lining and tamping machine 75 is like that of the first-described embodiment. It comprises machine frame 83. Undercarriages 76, 77 mount machine frame 83 on track 81 for mobility in an operating direction indicated by arrow 103. Track 81 is comprised of two rails 79, 80 fastened to ties 78 supported on ballast, each rail having a gage side and a field side. Central power plant 85 provides energy for machine drive 82 and all the operating drives on the machine. Central control panel 108 is mounted in operator's cab 107 to control the operation of the machine. Track correction is controlled by leveling and lining reference system 87 comprising tensioned reference wires supported on rail sensing rollers running on the track rails. A respective driver's cab 84 is mounted on each end of machine frame 83. The illustrated elongated machine frame is an articulated frame comprising two parts linked together for pivoting about vertical axis 86, undercarriages 76, 76 being swivel trucks supporting the front ends of the two machine frame parts and single-axle undercarriage 77 supporting the rear end of the rear machine frame part.

In this embodiment and as best shown in FIGS. 7 and 8, four tamping tool units 88, 89, 90, 91 are aligned transversely to the track, each unit comprising a pair 92, 93, 94, 95 of reciprocable vibratory tamping tools including tamping picks 112, 113 immersible in the ballast respectively at the field side and the gage side of each rail 79, 80. Each tamping tool unit further comprises drive means for reciprocating the tamping tools in a direction extending substantially perpendicularly to the ties an for vibrating the tamping tools, and drive 117, 118 for vertically adjusting each tamping tool unit 88 to 91.

Respective transversely pivotal carrier frames 100, 101 support field-side tamping tool units 88, 91. Pairs 92, 95 of the tamping tools of the field-side tamping tool units are vertically adjustably mounted on tamping tool carriers 141, 141 by vertical adjustment drives 140. The pivotal carrier frames are mounted on machine frame 83, each carrier frame being pivotal about a vertical axis 98, 99 in a plane extending substantially parallel to the track, and an independent drive 96, 97 is connected to each carrier frame 100, 101 for pivoting the carrier frame.

This simple and structurally very robust tamping tool arrangement with the independent adjustability of four tamping tool units advantageously enables the tamping tools to be individually repositioned for work in even the most difficult track and switch sections and to adapt to various tie positions. The pivotal carrier frames transversely adjustably support the field-side tamping tool units firmly on the machine frame and withstand the highest operating stresses. Their independent transverse adjustment enables these tamping tool units to be positioned rapidly, individually and without interference with each other to avoid any track obstacles and to be centered properly for tamping the long ties interconnecting the main and branch tracks at a switch. In addition, this arrangement enables the operator to observe and control the operation of the tamping tool units very well while the tamping picks are immersed in the ballast and during tamping. Furthermore, this advantageous transverse adjustability of the field-side tamping tool units does not require a transverse guide rail projecting laterally beyond the machine frame because the carrier frames may be rapidly pivoted back.

The tamping tool units precede rear swivel truck 76 in the operating direction and are closely adjacent thereto, and vertical axes 98, 99 about which carrier frames 100, 101 are transversely pivotal trail this swivel truck in the operating direction. This rear swivel truck is arranged intermediate front swivel truck 76 and single-axle undercarriage 77 mounting respective ends of the machine frame parts.

Machine 75 further comprises track lifting and lining unit 105 capable of leveling and lining track switches mounted on machine frame 83 between the swivel trucks and preceding tamping tool units 88 to 91 in the operating direction to form a track leveling, lining and tamping machine. Track lifting and lining unit 105 has a frame mounted on flanged rollers 104 on track rails 79, 80 and linked to machine frame 83 by lifting and lining drives. It carries lifting hooks 123 and lifting rollers 124 engageable with rails 79, 80 of track 81.

The illustrated switch leveling, lining and tamping machine further comprises transversely pivotal auxiliary track lifting device 106 mounted on machine frame 83 between the swivel trucks and preceding track lifting and lining unit 105 in the operating direction for selectively lifting branch track 111 to the right or the left of track 81. As seen in FIG. 8, auxiliary track lifting device 106 comprises carrier frame 126 equipped with a pair of pivotal flanged rail engaging and lifting rollers 125. As FIG. 7 illustrates, auxiliary track lifting device 106 as well as tamping tool unit 91 is transversely pivotal into alignment with branch track 111 and has double-flanged rollers running on rail 110 of branch track 111 while undercarriages 76, 77 of machine 75 run on main track 81.

As shown in FIG. 8, auxiliary track lifting device 106 comprises telescopingly extensible two-part carrier arm 129, 131, the carrier arm part 131 being rotatably supported on machine frame 83 and a drive being connected to this carrier arm part to rotate the same about a vertical pivot. Drive 130 connects carrier arm parts 129 and 131 to enable the carrier arm to be longitudinally extended and retracted. The free outer end of carrier arm part 129 carries freely rotatable pulley 132 guiding rope 127 one end of which is affixed to hydraulic cylinder 128 housed inside carrier arm part 129 and the opposite end of which is attached to the carrier frame 126 equipped with flanged rail engaging and lifting rollers 125. In this figure, field-side tamping tool unit 91 is seen centered over outer rail 110 of branch track 111 while opposite field-side tamping tool unit 88 and associated gage-side tamping tool unit 89 straddle rail 80 of main track 81. The other gage-side tamping tool unit 90 is centered over inner rail 109 of the branch track. Two of the tamping tool units 88 to 91 are associated with each rail 79, 80 and the associated tamping tool units project transversely to the track at the sides thereof facing away from each other while the facing sides of associated tamping tool units 88, 89 and 90, 91 at each track rail are substantially plane and parallel to each other. The facing sides of the associated tamping tool units are arranged mirror-symmetrically with respect to a vertical plane of symmetry extending through each track rail 79, 80. This asymmetrical configuration of the tamping tool units enables the associated gage-side and field-side tamping tool units to be advantageously arranged closely adjacent each other so that they can be readily observed by the operator during tamping while being capable of effectively tamping ballast under the rail supports at the intersections of the tie and rails.

Figure 9:
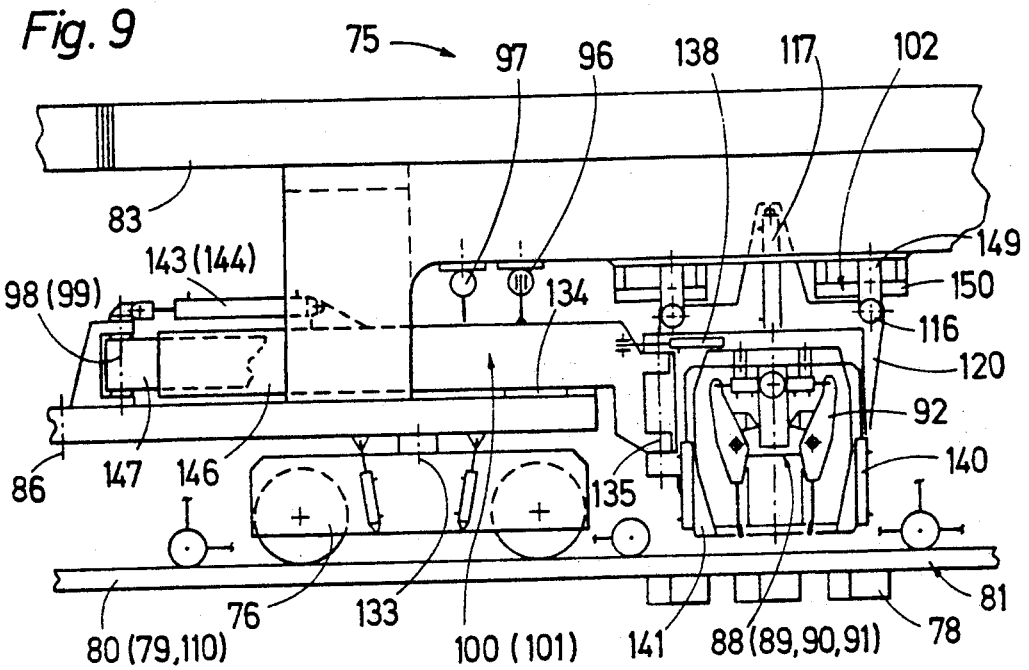
FIG. 9 is an enlarged fragmentary side elevational view showing the field-side tamping tool unit mounted on the pivotal carrier frame.

As shown in FIG. 9, each carrier frame 100, 101 is elongated and has one end 145 supporting respective field-side tamping tool unit 88, 91 and an opposite end pivoted about vertical axis 98, 99. Machine frame 83 comprises horizontally extending sliding and guide bearing element 134 supporting each carrier frame adjacent the one end. The one carrier frame end 145 projects freely in the operating direction from intermediate swivel truck 76 and a respective vertical axis 98, 99 about which elongated carrier frames 100, 101 is transversely pivotal is in substantially vertical alignment with a respective rail 79, 80. Each carrier frame is an elongated, telescopingly longitudinally extendable multi-part frame comprised of inner frame part 147 and outer frame part 146, and drive 143, 144 is connected to each carrier frame for longitudinally extending and retracting the multi-part frame whereby tamping tool unit 88, 91 on the carrier frame is longitudinally repositioned with respect to the track. As shown, inner frame part 147 is pivoted to machine frame 83 in a bearing bracket and drive 143, 144 connects outer frame part 146 to the bearing bracket. The illustrated multi-part carrier frames have a rectangular cross section, and independent drive 96, 97 connected to each carrier frame for pivoting the carrier frame and drive 143, 144 for longitudinally extending and retracting each carrier frame are hydraulic drives connected to an upper portion of the rectangular carrier frames.

Figure 10:
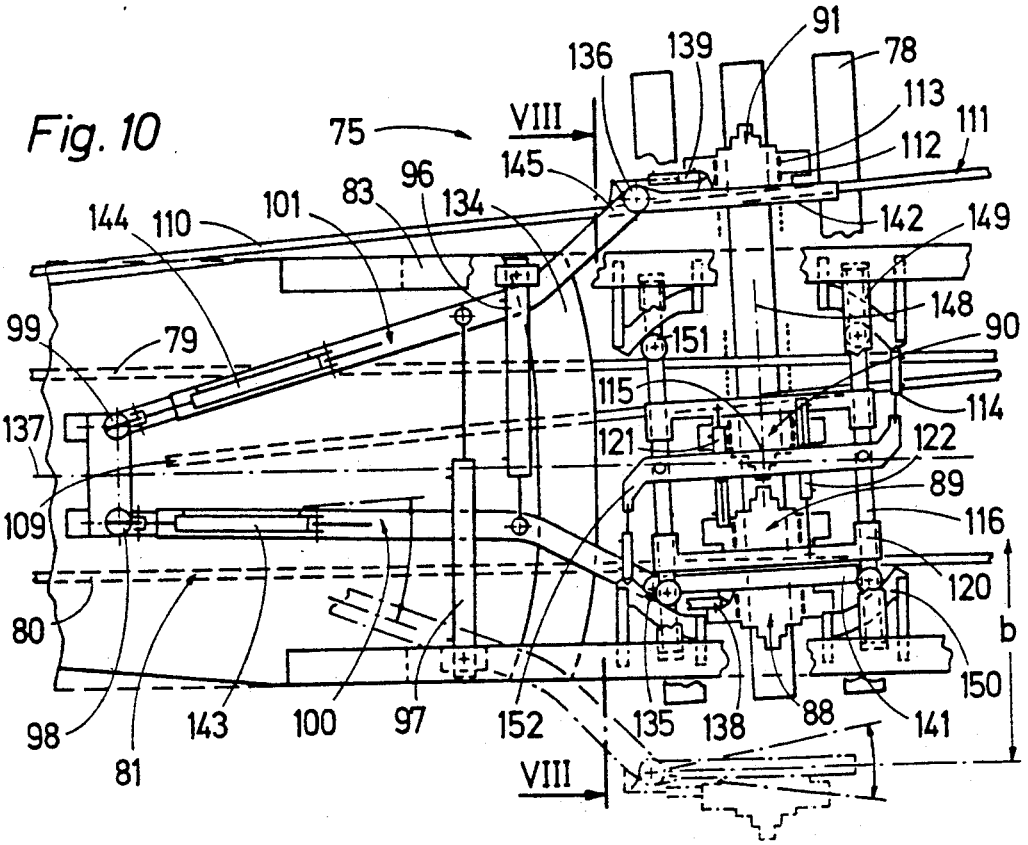
FIG. 10 is an enlarged fragmentary top view showing the two pivotal carrier frames and the field-side tamping tool units supported thereon, as well as the gage-side tamping tool units mounted on a rotatable carrier and being independently transversely adjustable, operating in a track switch.

As shown in FIG. 10, the inner ends of carrier frames 100, 101 are pivoted at 98, 99 on a common bearing bracket. The one end 145 of each elongated carrier frame is angled outwardly from center axis 137 of track 81 and the distance between vertical pivoting axis 98, 99 and tamping tool unit 88, 91 supported on the one carrier frame end 145 is at least about 4 to 5 meters, i.e. about twice to three and a half times the track gage, whereby the pivoting path b (see FIG. 10) of the one end 145 of each carrier frame is in the range of about 1.7 m. Branch track 111 is comprised of rails 109 and 110.

As shown in FIGS. 9 and 10, angled end 145 of each carrier frame 100, 101 pivotally supports a respective field-side tamping tool unit 88, 91 about another vertical axis 135, 136 and drive 138, 139 is connected to each field-side tamping tool unit for transversely pivoting this tamping tool unit towards and away from center 137 of track 81. Vertical axis 98, 99 of each carrier frame is arranged rearwardly of center axis 133 of intermediate swivel truck 76. In this arrangement, the entire transverse pivoting path of each tamping tool unit is about 2 m. As shown, carrier frames 100, 101 with their vertical pivoting axes 98, 99, drives 97, 98, 138, 139 and pivoting paths are arranged mirror-symmetrically with respect to center axis 137 of machine 75.

Gage-side tamping tool units 89, 90 and their vertical drives are mounted on machine frame 83 by means of common tamping tool carrier 102 rotably mounted on the machine frame. Drives 114 link the common tamping tool carrier to machine frame 83 for rotating the common carrier about vertical axis 115 defined by a line of intersection of transverse vertical plane 148 passing through the four aligned tamping tool units and a vertical plane passing through center line 137 of machine frame 83. Transverse guide beams 116 on common tamping tool carrier 102 transversely displaceably mount gage-side tamping tool units 89, 90 for transverse displacement of their tamping tool carriers 119, 120 by independent transverse adjustment drives 121, 122 connected to each gage-side tamping tool unit for independent transverse adjustment thereof with respect to the machine frame. Independent vertical adjusting drives 117, 118 are connected to the tamping tool carriers for vertically adjusting the gage-side tamping tool units on common carrier 102. To facilitate the rotation of common tamping tool carrier 102, transverse carrier elements 149, which are connected to transverse guide beams 116, are supported on arcuate guide bearings 150 affixed to machine frame 83. Guide rollers 151 are journaled to the ends of transverse carrier elements 149 for guidance along the arcuate guide bearings. The transverse carrier elements of the common carrier are linked respectively to arcuate guide bearings 150 and a center carrier beam 152. The common carrier with its gage-side tamping tool units is rotatable through an angle of about 17°.

With this arrangement, the gage-side tamping tool units are repositionable independently of each other and of the field-side tamping tool units so that all tamping tools may be readily and accurately centered and/or positioned in relation to any track obstacle encountered along the track. The transverse guides for the gage-side tamping tool units permit sufficient transverse displacement thereof but do not extend beyond the sides of the machine frame and do not interfere with the operation of the pivotal carrier frames for the field-side tamping tool units. The separate support for the transverse adjustment of the gage-side and field-side tamping tool units advantageously relieves the same of undue stresses to which the transverse displacement means are subjected when the tamping picks are immersed rapidly in the ballast. The rotatable mounting of the common tamping tool carrier for the gage-side tamping tool unit combined with the transverse displaceability of the units provides a simple structural solution for the problem of orienting their tamping picks parallel to the tie to be tamped and to center them accurately. On the other hand, the switch areas farther removed from the center of the main track at the branch track are tamped by the outwardly pivotal field-side tamping tool units. This makes the machine highly adaptable to even the most difficult switch work.

Mobile track leveling, lining and tamping machine 75 illustrated in FIGS. 6 to 10 operates in the following manner:

When the machine is operated along tangent main track 81, the two carrier frames 100, 101 are pivoted by hydraulic drives 96, 97 until the field-side tamping tool units 88, 91 with their pairs 92, 95 of tamping tools are positioned adjacent the field sides of track rails 79, 80. At the same time, common tamping tool carrier 102 is rotated about vertical axis 115 by drives 114 until transverse guide beams 116 extend perpendicularly to center axis 137. Drives 121, 122, which are linked to tamping tool carriers 119, 120 of gage-side tamping tool units 89, 90 are operated until their pairs 93, 94 of tamping tools are transversely displaced to be positioned adjacent the gage sides of the track rails. For tamping, vertical adjustment drives 140, 117, 118 are operated to immerse the tamping picks of pairs 92 to 95 of the tamping tools in the ballast. During the tamping operation, machine 75 moves intermittently from tie to tie for tamping until it reaches the switch with main track 81 and branch track 111 where tamping must be effected at rails 79, 80 of the main track as well as rails 109, 110 of the branch track, including the frog therebetween. For this purpose, field-side tamping tool unit 91 first tamps the tie at the field side of rail 79 of main track 81 and is then pivoted with its carrier arm 101 by operation of drive 97 into the position shown in full lines in FIG. 7. At the same time, this tamping tool unit is rotated about vertical axis 136 by drive 139 so that tamping picks 112, 113 will be positioned parallel to tie 78 which extends obliquely in this switch area. For the same purpose, opposite field-side tamping tool unit 88 is rotated by drive 138 to position its tamping picks parallel to tie 78. With respect to the tamping picks of gage-side tamping tool units 89, 90, this is accomplished by rotating common tamping tool carrier 102 about axis 115 by means of drives 114 (see FIG. 10). The two tamping tool carriers 119, 120 are transversely displaced by operation of drives 121, 122 until gage-side tamping tool units 89, 90 are centered above the area of rail 80 and 109 to be tamped.

At the same time, lifting rollers 125 of auxiliary track lifting device 106 are engaged with rail 110 of branch track 111. Before tamping, the two lifting hooks 123 and, if needed, the two lifting rollers 124 are brought into engagement with rails 79, 80 of main track 81 and the hydraulic lifting and lining drives of track lifting and lining unit 105 as well as hydraulic drive 128 of auxiliary track lifting device 106 are then operated under the control of leveling and lining reference system 87, the switch being engaged at three points during the leveling and lining operation, as indicated by three small, upwardly pointing arrows in FIG. 8. In this correct track position, the tie is tamped by tamping tool units 88 to 91 to fix the switch in the desired position. While the track remains lifted, field-side tamping tool unit 91 is slightly transversely moved until tamping picks 112, 113 are positioned at the other side of rail (see the dotted lines in FIG. 10). In the same manner, gage-side tamping tool unit 90 is slightly transversely displaced along transverse guide beams 116 for tamping in the area between the frog and rail 79. After all four tamping tool units have been raised from the tamping positions, machine 75 is advanced to the next tie 78 in the switch where the above-described tamping cycle is repeated.

What is claimed is;

1. A mobile track tamping machine comprising (a) a machine frame, (b) undercarriages mounting the machine frame on a track for mobility in an operating direction, the track being comprised of two rails fastened to ties supported on ballast, each rail having a gage side and a field side, (c) a plurality of independently transversely and vertically adjustable tamping tool units aligned transversely to the track, each tamping tool unit comprising (1) a pair of reciprocable vibratory tamping tools including tamping picks immersible in the ballast, (2) drive means for reciprocating the tamping tools in a direction extending substantially perpendicularly to the ties and for vibrating the tamping tools, and (3) a drive for vertically adjusting the unit, (d) respective elongated carrier frames for two of said tamping tool units mounted on the machine frame, each carrier frame having one end supporting a respective one of the tamping tool units and an opposite end spaced from the one end and pivoted about a vertical axis for pivoting the carrier frame transversely of the rails in a plane extending substantially parallel to the track, and (e) an independent drive connected to each carrier from for pivoting the carrier frame.

2. The mobile track tamping machine of claim 1, comprising two of said tamping tool units, each unit comprising a respective pair of tamping tools arranged respectively at the gage side and field side of a respective one of the track rails.

3. The mobile track tamping machine of claim 2, wherein the machine frame comprises a horizontally extending sliding and guide bearing element supporting each carrier frame adjacent the one end.

4. The mobile track tamping machine of claim 3, wherein the one end of each carrier frame projects freely in the operating direction from one of the undercarriages and a respective one of the vertical axes about which the elongated carrier frames are transversely pivotal is in substantial vertical alignment with a respective one of the track rails.

5. The mobile track tamping machine of claim 3, wherein the one end of each elongated carrier frame is angled outwardly from the center of the track and the distance between the vertical pivoting axis and the tamping tool unit supported on the one carrier frame end is at least about 4 to 5 m whereby the pivoting path of the one end of each carrier frame is in the range of about 1.7 m.

6. The mobile track tamping machine of claim 2, wherein the one carrier frame end pivotally supports a respective one of the tamping tool units about another vertical axis, the one end of each carrier frame projecting freely in the operating direction from one of the undercarriages, and further comprising a drive connected to each tamping tool unit for transversely pivoting each tamping tool unit towards and away from the center of the track.

7. The mobile track tamping machine of claim 6, wherein the entire transverse pivoting path of each tamping tool unit is about 2 m.

8. The mobile track tamping machine of claim 2, wherein each carrier frame is a, telescopingly longitudinally extendable multi-part frame, further comprising a drive connected to each carrier frame for longitudinally extending and retracting the multi-part frame whereby the tamping tool unit on the carrier frame is longitudinally repositioned with respect to the track.

9. The mobile track tamping machine of claim 8, wherein the multi-part carrier frames have a rectangular cross section and the independent drive connected to each carrier frame for pivoting the carrier frame and the drive connected to each carrier frame for longitudinally extending and retracting the multi-part frame are hydraulic drives connected to an upper portion of the rectangular carrier frames.

10. The mobile track tamping machine of claim 9, wherein the one carrier frame end pivotally supports a respective one of the tamping tool units about another vertical axis further comprising a drive connected to each tamping tool unit for transversely pivoting each tamping tool unit towards and away from the center of the track, and wherein the carrier frames with their vertical pivoting axes, drives and pivoting paths are arranged mirror-symmetrically with respect to a center axis of the machine.

11. The mobile track tamping machine of claim 2, wherein each tamping tool is mounted for pivoting with its tamping pick in a transverse plane about an axis extending parallel to the track, and further comprising a drive connected to each tamping tool for independently pivoting each tool.

12. The mobile track tamping machine of claim 1, comprising four of said tamping tool units arranged respectively at the gage side and field side of each track rail and each unit comprising an independent drive for vertically adjusting each tamping tool unit for immersing the tamping picks in the ballast, and wherein the transversely pivotal carrier frames support at least the field-side tamping tool units.

13. The mobile track tamping machine of claim 12, wherein the machine frame comprises a horizontally extending sliding and guide bearing element supporting each carrier frame adjacent the one end.

14. The mobile track tamping machine of claim 13, wherein the one end of each carrier frame projects freely in the operating direction from one of the undercarriages and a respective one of the vertical axes about which the elongated carrier frames are transversely pivotal away from the gage-side tamping tool units is in substantial vertical alignment with a respective one of the track rails.

15. The mobile track tamping machine of claim 12, further comprising a common tool carrier mounting the gage-side tamping tool units on the machine frame.

16. The mobile track tamping machine of claim 15, further comprising transverse guide means for transversely displaceably mounting the gage-side tamping tool units and independent transverse adjusting drives connected to each gage-side tamping tool unit for independent transverse adjustment thereof with respect to the machine frame.

17. The mobile track tamping machine of claim 16, wherein the common tool carrier supports the transverse guide means and the independent vertical and transverse adjusting drives for the gage-side tamping tool units, and further comprising a drive for rotating the common carrier about a vertical axis defined by a line of intersection of a transverse vertical plane passing through the four aligned tamping tool units and a vertical plane passing through a center line of the machine frame.

18. The mobile track tamping machine of claim 12, wherein two of the tamping tool units are associated with each other at each rail and the two associated tamping tool units project transversely to the track at the sides thereof facing away from each other while the facing sides of the associated tamping tool units at each track rail are substantially plane and parallel to each other, the facing sides of the associated tamping tool units being arranged mirror-symmetrically with respect to a vertical plane of symmetry extending through each track rail.

19. The mobile track tamping machine of claim 12, wherein the one end of each elongated carrier frame is angled outwardly from the center of the track and the distance between the vertical pivoting axis and the field-side tamping tool unit supported on the one carrier frame end is at least about 4 to 5 m whereby the pivoting path of the one end each carrier frame is in the range of about 1.7 m.

20. The mobile track tamping machine of claim 12, wherein the one carrier frame end pivotally supports a respective one of the field-side tamping tool units about another vertical axis, further comprising a drive connected to each field-side tamping tool unit for transversely pivoting each tamping tool unit towards and away from the center of the track.

21. The mobile track tamping machine of claim 12, wherein each carrier frame is a, telescopingly longitudinally extendable multi-part frame, further comprising a drive connected to each carrier frame for longitudinally extending and retracting the multi-part frame whereby the field-side tamping tool unit on the carrier frame is longitudinally repositioned with respect to the track.

22. The mobile track tamping machine of claim 21, wherein the multi-part carrier frames have a rectangular cross section and the independent drive connected to each carrier frame for pivoting the carrier frame and the drive connected to each carrier frame for longitudinally extending and retracting the multi-part frame are hydraulic drives connected to an upper portion of the rectangular carrier frames.

23. The mobile track tamping machine of claim 12, wherein the one carrier frame end pivotally supports a respective one of the field-side tamping tool units about another vertical axis further comprising a drive connected to each field-side tamping tool unit for transversely pivoting each field-side tamping tool unit towards and away from the center of the track, and wherein the carrier frames with their vertical pivoting axes, drives and pivoting paths are arranged mirror-symmetrically with respect to a center axis of the machine

24. The mobile track tamping machine of claim 1, wherein the machine frame is an articulated frame comprising two parts linked together for pivoting about a vertical axis rearwardly of the one undercarriage whereon the machine frame is mounted, the tamping tool units precede the one undercarriage in the operating direction and are closely adjacent thereto, and the vertical axes about which the carrier frames are transversely pivotal trail the one undercarriage in the operating direction.

25. The mobile track tamping machine of claim 24, wherein the one undercarriage is a swivel truck arranged intermediate two undercarriages mounting respective ends of the machine frame parts.

26. The mobile track tamping machine of claim 1, wherein the undercarriages comprise two widely spaced swivel trucks, further comprising a track lifting and lining unit capable of leveling and lining track switches mounted on the machine frame between the swivel trucks and preceding the tamping tool units in the operating direction to form a track leveling, lining and tamping machine, and a transversely pivotal auxiliary track lifting device mounted on the machine frame between the swivel trucks and preceding the track lifting and lining unit in the operating direction for selectively lifting a branch track to the right or the left of the track.

* * * * *